US011484118B2

(12) United States Patent
Stetson

(10) Patent No.: US 11,484,118 B2
(45) Date of Patent: Nov. 1, 2022

(54) MULTIPURPOSE STORAGE, MAINTENANCE AND DISPLAY CABINET SYSTEM FOR SCUBA GEAR

(71) Applicant: Ward Marshall Stetson, Woodstock, GA (US)

(72) Inventor: Ward Marshall Stetson, Woodstock, GA (US)

( * ) Notice: Subject to any disclaimer, the term of this patent is extended or adjusted under 35 U.S.C. 154(b) by 0 days.

(21) Appl. No.: 17/643,468

(22) Filed: Dec. 9, 2021

(65) Prior Publication Data

US 2022/0265044 A1 Aug. 25, 2022

Related U.S. Application Data

(60) Provisional application No. 63/200,176, filed on Feb. 19, 2021.

(51) Int. Cl.

| | |
|---|---|
| ***A47B 81/00*** | (2006.01) |
| ***A47B 61/00*** | (2006.01) |
| ***A47B 96/06*** | (2006.01) |
| ***B63C 11/02*** | (2006.01) |

(52) U.S. Cl.

CPC ..... *A47B 81/00* (2013.01); *A47B 61/00* (2013.01); *A47B 96/067* (2013.01); *B63C 11/02* (2013.01); *A47B 2220/0077* (2013.01); *B63C 2011/024* (2013.01); *B63C 2011/025* (2013.01)

(58) Field of Classification Search

CPC ..... A47B 81/00; A47B 61/00; A47B 96/067; A47B 2220/0077; B63C 11/02; B63C 2011/024; B63C 2011/025

See application file for complete search history.

(56) References Cited

U.S. PATENT DOCUMENTS

| | | | | |
|---|---|---|---|---|
| 4,378,866 | A | 4/1983 | Pelavin | |
| 5,546,678 | A | 8/1996 | Dhaemers | |
| 5,815,944 | A | 10/1998 | Palmer | |
| 6,693,260 | B1 | 2/2004 | Rodrigues | |
| 6,772,889 | B2 | 8/2004 | Moceri | |
| 7,025,215 | B2 | 4/2006 | Bain et al. | |
| 8,481,895 | B2 | 7/2013 | Taylor et al. | |
| 8,726,534 | B2 | 5/2014 | Chappell et al. | |
| 9,107,973 | B1 * | 8/2015 | Robinson | A61L 2/10 |
| 9,669,122 | B1 | 6/2017 | Cruz-Acosta et al. | |
| 9,739,531 | B2 | 8/2017 | Goulet | |
| 9,919,196 | B2 | 3/2018 | Gellman | |
| 2003/0079368 | A1 | 5/2003 | Hoffman | |
| 2005/0217282 | A1 * | 10/2005 | Strohm | A23B 7/152 62/78 |
| 2007/0051686 | A1 | 3/2007 | Sausman | |
| 2008/0256826 | A1 * | 10/2008 | Zarembinski | F26B 21/004 34/235 |
| 2009/0064530 | A1 | 3/2009 | Moon et al. | |
| 2010/0299976 | A1 * | 12/2010 | Roselle | D06F 58/10 38/1 A |

(Continued)

*Primary Examiner* — Ko H Chan

(74) *Attorney, Agent, or Firm* — Dunlap Bennett & Ludwig, PLLC

(57) ABSTRACT

A gear cabinet system having two, physically separated, sides providing compartmentalization for wet and dry storage, respectively. The first side provides a first space having ventilation functionality and anti-microbial lighting functionality for drying and sanitizing wet gear. The second side defines a space for storing and displaying dry gear.

9 Claims, 5 Drawing Sheets

(56) References Cited

U.S. PATENT DOCUMENTS

| | | | | |
|---|---|---|---|---|
| 2015/0285516 | A1* | 10/2015 | Hanks | F24F 13/20 29/428 |
| 2017/0045295 | A1* | 2/2017 | Durham | F26B 25/005 |
| 2018/0120017 | A1* | 5/2018 | Wilson | F25D 23/006 |
| 2018/0369438 | A1* | 12/2018 | Grossman | A61L 2/18 |
| 2020/0030471 | A1* | 1/2020 | Weller | A61L 2/26 |
| 2020/0072528 | A1* | 3/2020 | Buzzi | B01D 46/0028 |
| 2020/0173096 | A1 | 6/2020 | Williams | |

* cited by examiner

MULTIPURPOSE STORAGE, MAINTENANCE AND DISPLAY CABINET SYSTEM FOR SCUBA GEAR

CROSS-REFERENCE TO RELATED APPLICATION

This application claims the benefit of priority of U.S. provisional application No. 63/200,176, filed 19 Feb. 2021, the contents of which are herein incorporated by reference.

BACKGROUND OF THE INVENTION

The present invention relates to outdoor gear and more particularly, to a multipurpose storage, maintenance, and display cabinet system for scuba gear and other wet gear.

There is currently no commercially available storage cabinet that addresses the specific needs of recreational scuba divers. Specifically, there are no other cabinets with built-in ventilation and drainage systems for drying wet gear, and there are none that include an anti-microbial light that keeps the gear free from mold, mildew, and bacteria.

Most of what is available out there are metal storage cages for professional diving units, such as search and rescue. As a result, they merely rely on open air to facilitate drying. Furthermore, the current offerings would not work in a residential environment.

Accordingly, there is a need for a multipurpose storage, maintenance, and display cabinet system for gear that is wet immediately after use.

The system embodied in the disclosure provides for the storage, drying, sanitizing and display of scuba gear in an attractive storage unit, including a power ventilated drying compartment with anti-microbial lighting. The present invention also provides ample space for dry storage and an area to perform maintenance as well as display shelves for gear and memorabilia. The system embodied in the present invention also provides electrical and USB outlets for powering technical equipment such as dive computers, underwater cameras, and lights.

In sum, there are many storage cabinets available on the market; however, none are designed to meet the specific needs of handling scuba gear. The scuba cabinet system disclosed herein provides for the necessary storage, maintenance, and display needs of scuba gear, especially in a residential environment.

SUMMARY OF THE INVENTION

In one aspect of the present invention, a gear cabinet system providing the following: a first space, including: a ventilation system; and an anti-microbial system; and a second space for storage.

In another aspect of the present invention, the above-mentioned gear cabinet system, further including the following: a top compartment physically separated from the first and second spaces, the top compartment having one or more vent openings communicating to an exterior environment, wherein the ventilation system has a mesh floor along a bottom of the first space and a vent blower fluidly connecting the top compartment and the first space in such a way that air is urged from under the mesh floor into the first space; a bottom compartment physically separated from the first and second spaces, wherein the mesh floor separates the bottom compartment and the first space, wherein the anti-microbial system comprises a LED light source disposed along an upper portion of the first space, wherein the LED light source is at least partially disposed in the top compartment; a drip pan in the bottom compartment below the mesh floor; a divider physically separating the first and second spaces; one or more scuba brackets disposed along the divider in the first space; a scuba shelf elevated above the mesh floor in the first space; and a hanger rod along the upper portion of the first space.

These and other features, aspects and advantages of the present invention will become better understood with reference to the following drawings, description and claims.

DETAILED DESCRIPTION OF THE INVENTION

Figure 1:
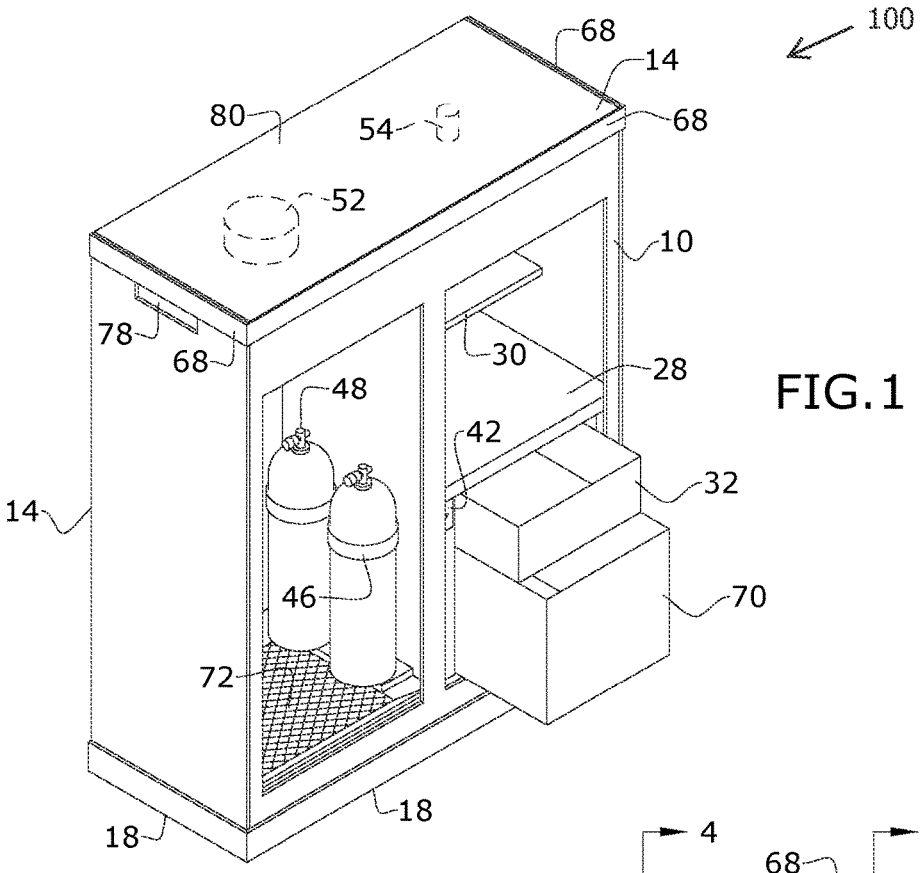
FIG. 1 is a perspective view of an exemplary embodiment of the present invention, shown without bifold doors.
Figure 2:
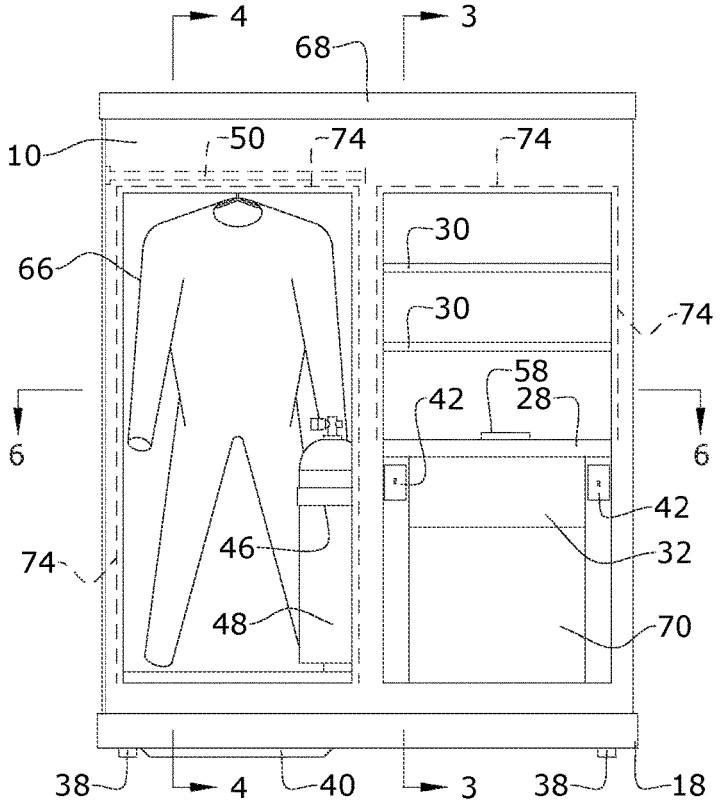
FIG. 2 is a front view of an exemplary embodiment of the present invention, shown without bifold doors.
Figure 3:
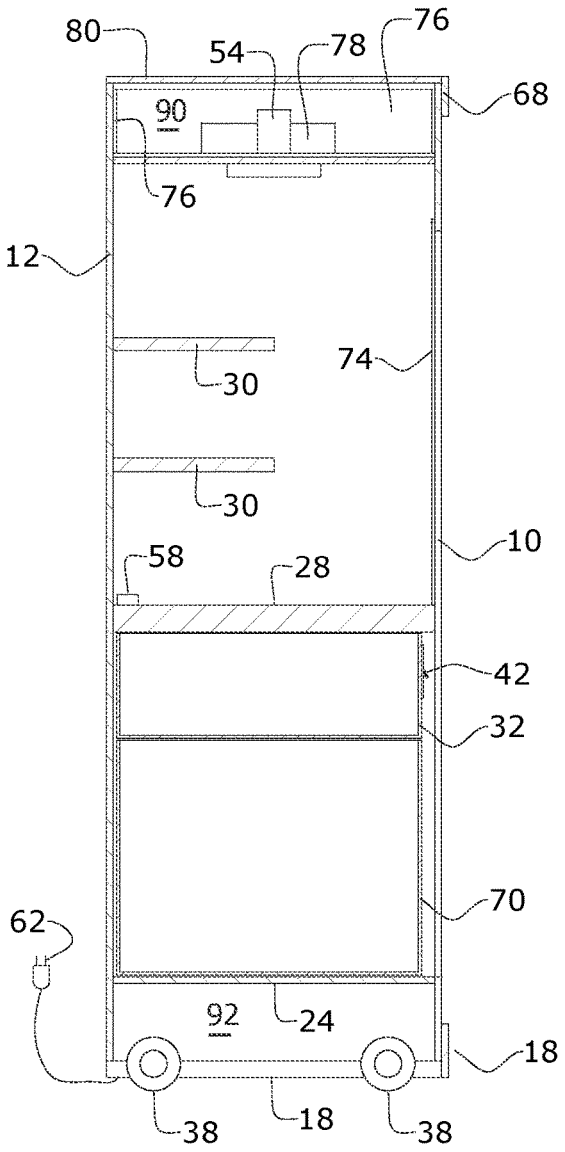
FIG. 3 is a section view of an exemplary embodiment of the present invention, taken along line 3-3 in FIG. 2.
Figure 4:
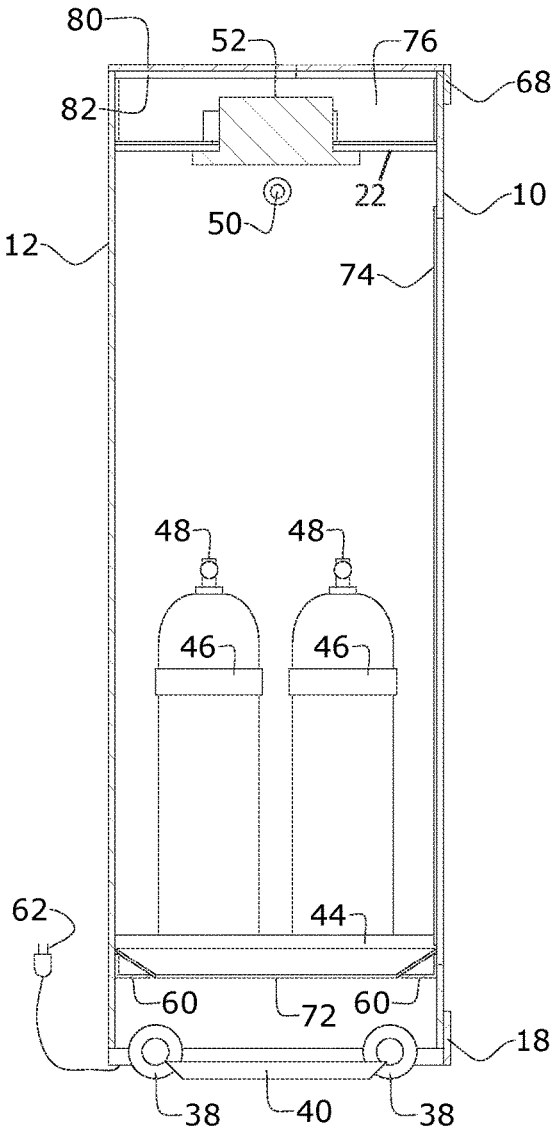
FIG. 4 is a section view of an exemplary embodiment of the present invention, taken along line 4-4 in FIG. 2.
Figure 5:
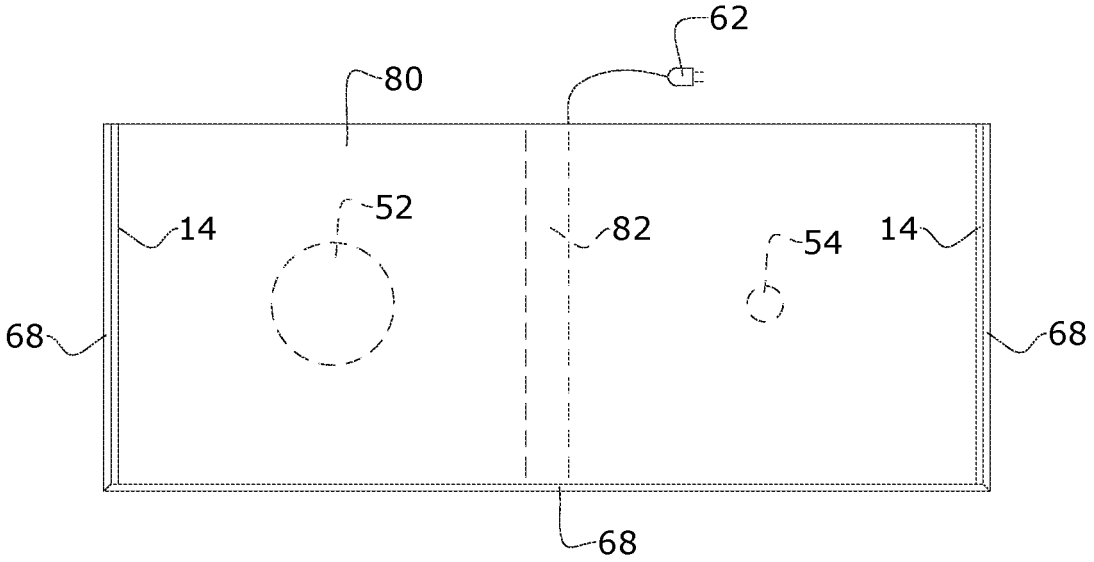
FIG. 5 is a top plan view of an exemplary embodiment of the present invention.
Figure 6:
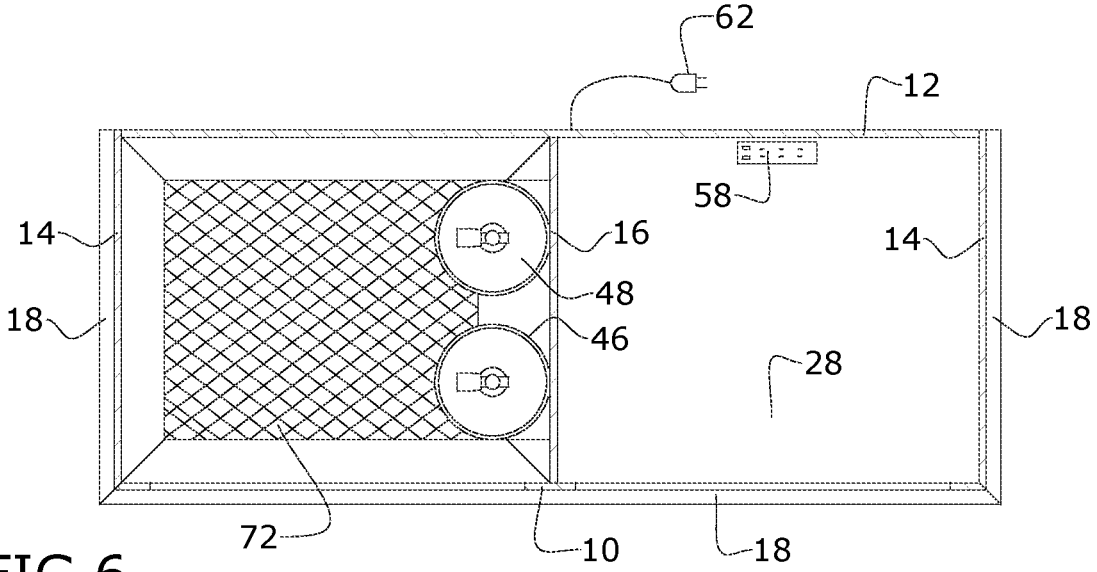
FIG. 6 is a section view of an exemplary embodiment of the present invention, taken along line 6-6 in FIG. 2.
Figure 7:
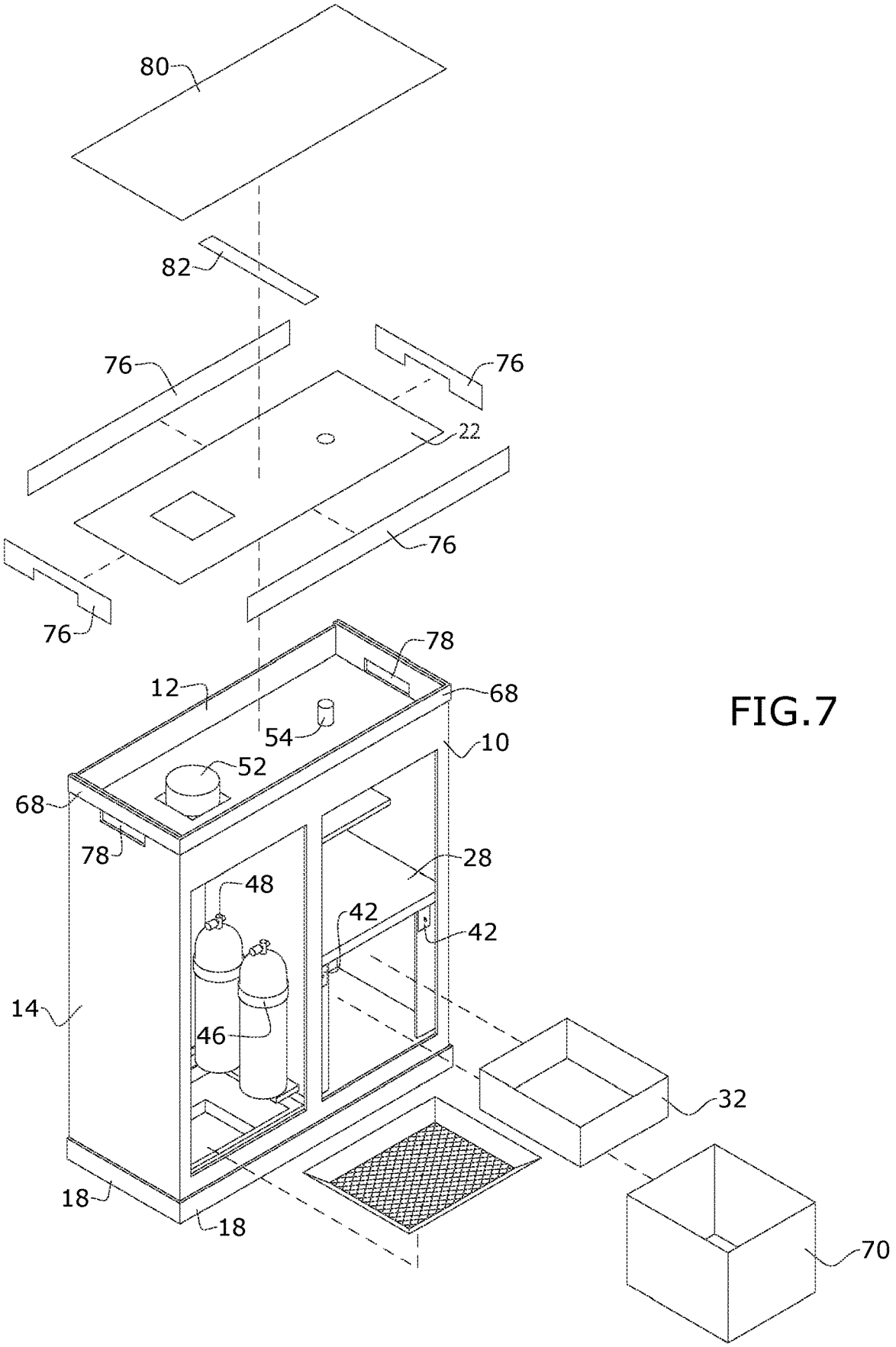
FIG. 7 is an exploded perspective view of an exemplary embodiment of the present invention, shown without bifold doors.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a gear cabinet system having two, physically separated, sides providing compartmentalization for wet and dry storage, respectively. The first side provides a first space having ventilation functionality and anti-microbial lighting functionality for drying and sanitizing wet gear. The second side defines a space for storing and displaying dry gear.

Referring to FIGS. 1 through 8, the present invention includes a multi-functional gear cabinet system 100 providing for the storage, drying, sanitization and the display of scuba gear.

ITEMIZED LIST OF SYSTEMIC COMPONENTS

10. front face panel
12. back panel
14. side panels
16. center divider/interior board
18. baseboard
22. top panel
24. bottom panel
26. peg board
28. countertop (e.g., butcher-block countertop)
30. shelves
32 drawers

34. bifold doors
38. casters
40. drip pan
42. switches—blower and lights
44. scuba tank shelf
46. scuba tank brackets
48. scuba tanks (shown stored in cabinet)
50. hanger rod
52. combination vent blower and anti-microbial LED light assembly
54. LED overhead light
58. power strip with USB ports
60. angled trim
62. electrical wiring
66. wetsuit (shown stored in cabinet)
68. casing molding
70. bin drawer
72. expanded metal
74. LED tape lighting
76. insulating liners
78. vent openings
80. top coverboard
82. support board The gear cabinet system 100 may include two separate sides providing compartmentalization for wet and dry storage, respectively. A first side (shown as the left side in the Figures) provides a first space/compartment for wet storage. A combination vent blower and anti-microbial LED light assembly 52 is fluidly connected to the first space to provide moving air to dry the equipment therein. (Note: heat breaks down wetsuit material so none is used). The air is drawn up through a mesh floor 72 at the bottom of the first space (from a separate bottom compartment 92) and pulled into a top compartment 90 where it is dispersed on either side of the cabinet by the way of vent openings 78 communicating with the exterior environment. The combination vent blower and anti-microbial LED light assembly may be adapted to move air at approximately 110 cfm or more. This flow rate is enough to replace the air in the first space four times per minute providing for faster drying. A drip pan 40 may be disposed below the mesh floor 72, in the bottom compartment 92, for catching drainage.

The combination vent blower and anti-microbial LED light assembly also provides LED anti-microbial light along the top of the first space for sanitizing the gear from bacteria and mold which is caused in part by the decaying organic materials in seawater. A heavy-duty rod 50 and hooks or other removable connecters may be installed in this first space compartment for hanging up any wet gear including wetsuit 66, BCDs, fins, etc.

The first space may include one or more scuba tank shelves 44 for supporting scuba tanks 48 above the mesh flooring 72. The scuba tank shelves 44 may be elevated above the mesh flooring 72 to facilitate ventilation and drainage therethrough. A tank bracket 46 may connect each scuba tank 48 to a vertical surface of the first space, such as a central divider 16 of the first and second spaces.

The second side of the cabinet system 100 (the right side in the Figures) defines a second space providing the following. The second space may provide drawers 32 and 70 for storing gear that is dry. There may be a countertop 28 above the drawers 32 to work on the gear. The countertop 28 may have a power strip 58 with USB ports installed to power technical diving gear such as computers, cameras, and lights. Shelves 30 may be disposed above the countertop 28 to provide a place to put smaller gear or to display favorite memorabilia. This second space may be lighted from above with a dimmable LED fixture. This LED fixture can be toggled, by way of a toggle switch 42, between various spectrum of light for viewing gear. There may be multi-colored LED lights attached to the backsides of the cabinet face frame that shine into the interior to provide various interesting display effects. Each side has a bifold door 34 to enclose everything. These bifold doors 34 may fold away easily for display purposes. They may include magnetic latches, pull handles and a latch for locking to keep all the gear secure.

Figure 8:
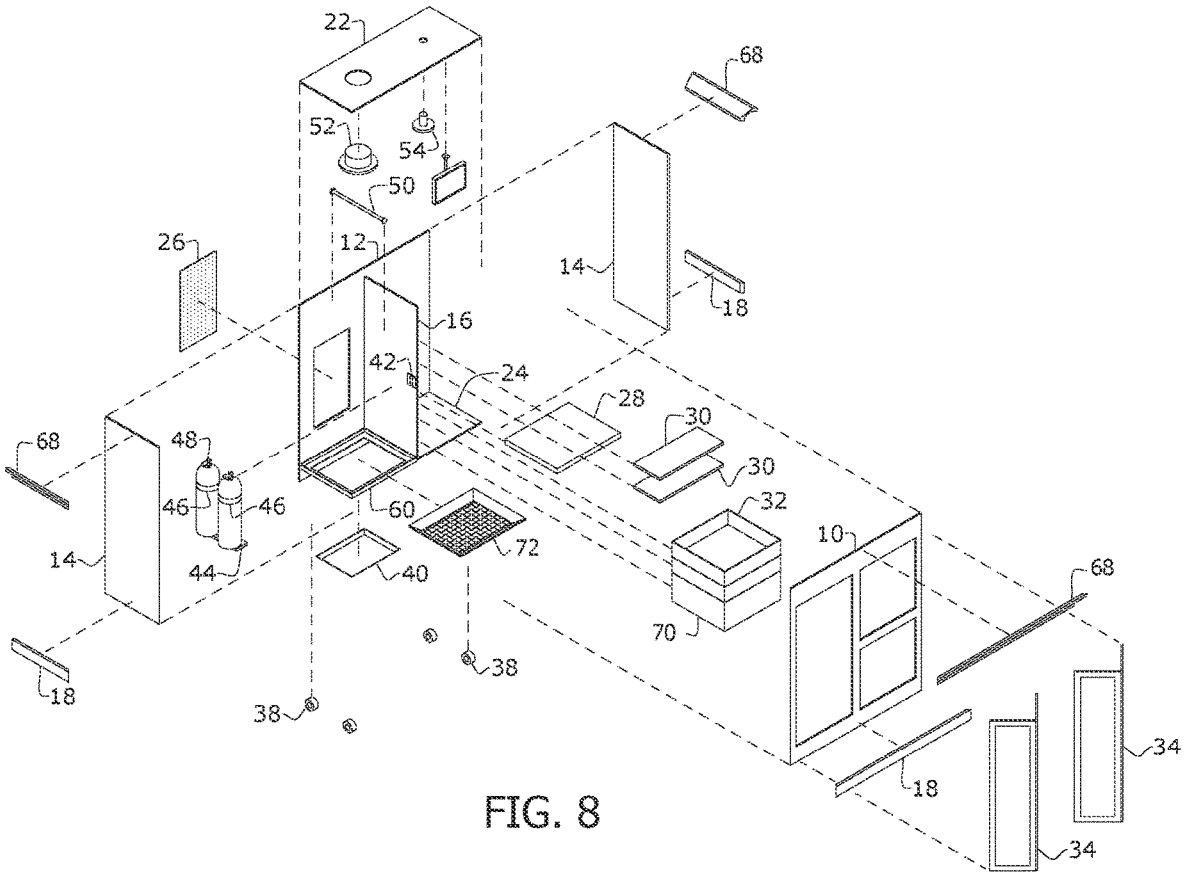
FIG. 8 is an exploded perspective view of an exemplary embodiment of the present invention, with bifold doors shown.

The main structure of the disclosure is a durable cabinet. The cabinet may include a front face panel 10 a back panel 12, side panels 14 and a center divider/interior board 16 that divides the first side from the second side. The front face panel 10 defines the openings to the first and second spaces. The cabinet may also have a baseboard 18, crown molding 20, a top panel 22, and a bottom panel 24. Below the bottom panel 24 may be casters 38 engaging the supporting surface. In some embodiments, a peg board 26 may be disposed in the back panel, as illustrated in FIG. 8.

The above-mentioned top compartment 90, supporting the vent openings and blowers 52, may be built with casing molding 68, insulating liners 76, a top coverboard 80, and one or more support boards 82. The bottom compartment 92 may be further defined by way of angled trim 60. The bottom compartment 92 may have apertures for electrical wiring 62, as well as provide space for the casters 38 and the drip pan 40.

The scuba cabinet system 100 needs to perform its functions as well as being attractive. A professional cabinet maker or manufacturer would be required to build this. The construction requires fine woodworking skills and tools. The cabinet maker would also provide professional painting and finishing. Once the structure of the cabinet is built, it would need to be moved to another location to perform the other tasks that wouldn't be in the scope of the cabinet maker. These tasks would include installing the electrical and ventilation components. These would include wiring, installing lighting, switches, power strip and ventilation blower. This requires a knowledge of electrical circuitry and electrical codes to ensure safety. The steel grate/mesh 72 used for ventilation/drainage will also need to be installed. It is unlikely that a cabinet maker would source this type of material and carry the required tools for cutting metal. Also, the drip pan 40 would need to be added separately. Other small items such as the hanger rod 50 and hooks can be installed either by the cabinet maker or later.

The ventilation system and anti-microbial light are critical to the function of this invention. The hanger rod 50 is needed for drying. The scuba shelf 44 and brackets 46 are required to safely store the tanks that are often filled with air at very high pressure and can be extremely dangerous if not properly stored and maintained. Drainage must also be provided. It is important to have the drawers 32 and 70 and shelving 30 for storage and display. The countertop 28 and power strip 58 are needed for performing maintenance.

LED tape lighting 74 could be optional. Hooks and their locations could be handled by the end user. To improve on the present invention, cabinet wall hooks could be installed on the back to prevent the risk of tip over. The cabinet could be made of metal for some applications where the appearance isn't critical. The cabinet could be made modular so that multiple units could be combined. This would be attractive to couples and families that dive together. There is also the opportunity to make these units as built-in cabinets for homes and businesses like dive shops.

A method of using the present invention may include the following. Most divers return from diving and their gear typically ends up in various bags tucked away in a corner. This is not ideal and often requires shuffling through the bags to find something. Hopefully, everything in the bags was sufficiently cleaned and dried prior to getting stored this way. Otherwise, mold, mildew and bacteria will have a nice dark environment to thrive.

Alternatively, the scuba cabinet system 100 disclosed above may be provided. The present invention lets the diver store all the gear in a very organized manner. Unlike other methods of storage, the diver can hang up the gear soaking wet and it does not matter. The ventilation system and drainage will ensure that all the gear dries quickly. Even if mold, mildew, or bacteria are present, they will be destroyed by the anti-microbial light. The cabinet provides an attractive display of the gear if the diver wants to show their friends. No need to pull it out of bags. The cabinet also can be locked to protect the diver's investment which can be substantial.

Additionally, the present invention can be used for any sport that requires a clean dry place for storage and display. Those involved in water sports such as surfing or jet skiing would benefit from the disclosure. It's also possible that other outdoor sports such as hunting and snow skiing which have gear that gets wet would enjoy the present invention as well.

As used in this application, the term "about" or "approximately" refers to a range of values within plus or minus 10% of the specified number. And the term "substantially" refers to up to 90% of an entirety or an extent. Additionally, the words "about," "approximately," or the like, when accompanying a numerical value, are to be construed as indicating a deviation as would be appreciated by one of ordinary skill in the art to operate satisfactorily for an intended purpose.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A gear cabinet system, comprising:
- a bottom compartment;
- a first space comprising
  - an anti-microbial system;
- a second space physically separated from the first space;
- a mesh floor physically separating the bottom compartment from the first space;
- a top compartment physically separated from the first and second spaces by way of an upper partition, the top compartment having one or more vent openings communicating to an exterior environment; and
- a vent blower connected to the upper partition so as to fluidly coupled the top compartment and the first space, wherein the vent blower is configured to urge air from the bottom compartment into the first space, and then through the vent blower and into the top compartment.

2. The gear cabinet system of claim 1, wherein the anti-microbial system comprises a LED light source disposed along an upper portion of the first space.

3. The gear cabinet system of claim 2, wherein the LED light source is at least partially disposed in the top compartment.

4. The gear cabinet system of claim 2, further comprising a drip pan in the bottom compartment below the mesh floor.

5. The gear cabinet system of claim 2, further comprising a divider physically separating the first and second spaces.

6. The gear cabinet system of claim 5, further comprising one or more scuba brackets disposed along the divider in the first space.

7. The gear cabinet system of claim 6, further comprising a scuba shelf elevated above the mesh floor in the first space.

8. The gear cabinet system of claim 7, further comprising a hanger rod along the upper portion of the first space.

9. The gear cabinet system of claim 8, wherein the second space comprises:
- shelves;
- a countertop below the shelves, wherein the countertop is dimensioned to accommodate a wet suit;
- a power strip operatively associated with the countertop;
- drawers below the countertop;
- a dimmable LED fixture above the countertop, wherein the dimmable LED fixture is housed in the top compartment; and
- a bi-fold door.

* * * * *